United States Patent [19]

Weaver

[11] 4,342,127

[45] Aug. 3, 1982

[54] APPARATUS FOR FORMING RAILROAD SPIKES AND THE LIKE

[75] Inventor: Simeon D. Weaver, Birmingham, Ala.

[73] Assignee: Azcon Corporation, New York, N.Y.

[21] Appl. No.: 181,995

[22] Filed: Aug. 28, 1980

[51] Int. Cl.[3] ..... B21G 3/12; B21G 3/16

[52] U.S. Cl. ..... 10/57; 10/58; 10/59

[58] Field of Search ..... 10/56, 57, 58, 59, 60, 10/61, 62, 63, 15, 49

[56] References Cited

U.S. PATENT DOCUMENTS

| | | | |
|---|---|---|---|
| 319,587 | 6/1885 | Koplin | 10/57 |
| 343,839 | 6/1886 | North | 10/58 |
| 415,494 | 11/1889 | Bowman | 10/57 |
| 422,151 | 2/1890 | Pessenger | 10/56 |
| 1,345,064 | 6/1920 | Berkeley | 10/58 |
| 1,774,915 | 9/1930 | Crane | 10/57 |

*Primary Examiner*—Nicholas P. Godici

*Attorney, Agent, or Firm*—Woodford R. Thompson, Jr.

[57] ABSTRACT

Railroad spikes and the like are formed by apparatus having a stop contacting and limiting movement of the forwardmost end of a heated stock bar. A bending finger holds the forwardmost end in spaced relation from a stationary gripper die, while a movable gripper die engages the bar and moves it into engagement with the stationary gripper die. Cutter dies then engage the bar to form a tapered end portion at a predetermined location rearward of the forwardmost end as a head forming die engages the forwardmost end to form a spike head. The movable gripper die is urged toward the bar with a force which is proportional to the force exerted by the head forming die on the movable gripper die. The finished spike is ejected when it contacts an ejector finger.

18 Claims, 16 Drawing Figures

FIG. 11
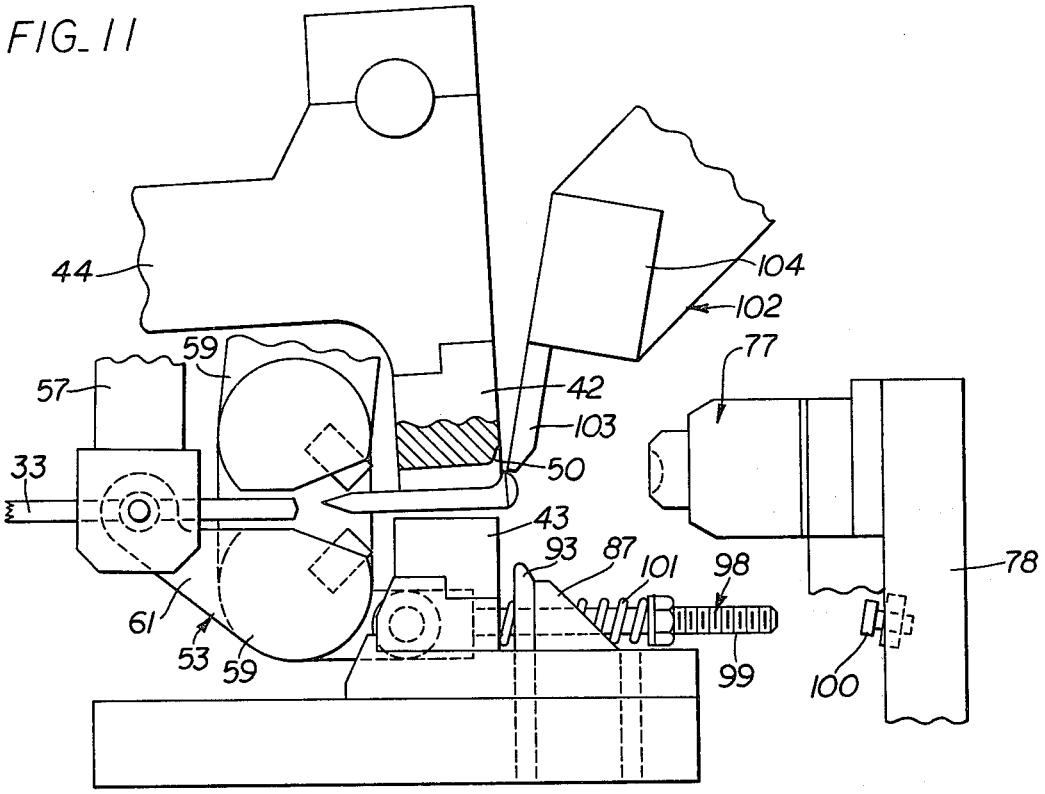
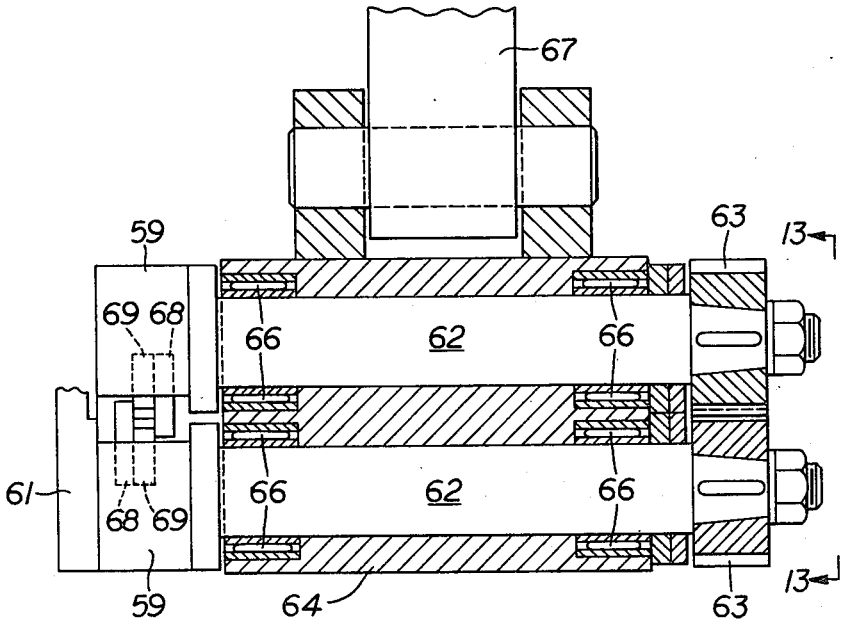
FIG. 12
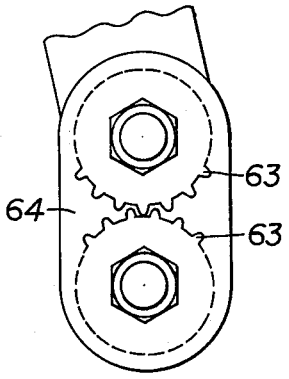
FIG. 13

APPARATUS FOR FORMING RAILROAD SPIKES AND THE LIKE

BACKGROUND OF THE INVENTION

This invention relates to apparatus for forming elongated articles such as railroad spikes, bolts, nails and the like and more particularly to apparatus for forming such articles from a heated stock bar fed intermittently into the apparatus.

Heretofore in the art to which my invention relates, difficulties have been encountered with prior art devices used to form spikes and the like due to the fact that such devices produce spikes having end portions which are not formed to the exact shape and size required. Also, such spikes have offset heads which only marginally meet design specification requirements. Furthermore, these devices operate in multi-stage forging cycles to produce spikes in a very uneconomical and inconsistent manner, with the operation of such devices resulting in a substantial amount of down time and requiring considerable maintenance to maintain the apparatus in satisfactory working order.

Also, cumbersome gripping dies have been utilized heretofore to exert a constant gripping force to hold the heated stock bar in position while the tapered end portion and the offset head is formed. Spike body deformation is often experienced when soft or overheated stock bars are held by these dies since such bars require substantially less gripping force than the amount normally applied.

Massive compression dies have been used concomitantly with confining dies to form the tapered end portion as well as to maintain flat parallel sides for such end portion which are perpendicular to the tapered surfaces thereof. These confining dies do not adequately control the excessive bulging, swelling and flash usually associated with this operation thus resulting in the formation of tapered end portions which are not shaped properly.

Rotary dies, such as those disclosed in Great Britain Pat. No. 978, have also been employed in forming the tapered end portion for a spike. However, arcuate sides are formed by the cutting action of such dies thus resulting in only an approximately shaped tapered end portion being formed.

Another difficulty encountered is the positioning of the stock bar at the proper location to present the required amount of metal to form a spike head which meets design specifications. Also, devices heretofore employed form heads which are not uniform since they vary in length, width, thickness and the offset relationship of the head to the body of the spike.

The following U.S. patents disclose spike forming machines which utilize gripper dies for holding the bar, compressive dies to form the tapered end portion, and head forming dies: U.S. Pat. Nos. 319,587; 393,438; 415,494, 1,774,915; 2,507,817; 2,832,979 and 3,906,566.

SUMMARY OF THE INVENTION

In accordance with my invention, I overcome the above and other difficulties by providing an apparatus for producing railroad spikes in a single stage operation and in a safe, economical and consistent manner. My improved apparatus forms high quality spikes at a high rate of production that readily meets all design specifications and requirements. Also, my apparatus requires a minimum of maintenance to maintain this high level of production, thus significantly reducing down time and cost.

An object of my invention is to form spikes having true tapered end portions without the use of massive compressive and confining dies and with adjacent parallel flat sides of the tapered end portions being perpendicular to the tapered surfaces thereof and free of bulging, swelling and flash.

Another object is to provide apparatus having an adjustable side gripping force which varies in proportion to the amount of force required to form the head. That is, I provide apparatus which is self-adjusting to grip colder or high carbon stock bars with more gripping force when the head is formed as compared to a lesser gripping force which would be required with hotter or low carbon stock bars, thus greatly reducing spike body deformation.

A further object of my invention is to provide means for ejecting a composite finished spike without unsightly marks and blemishes to the spike body as usually occurs where ejector pins and the like are employed.

A still further object of my invention is to provide apparatus that is simple of construction and requires a minimum of cooperating components and functions to form the finished spike. Yet, the interchangeability of those components for worn out components can be accomplished in a quick and easy manner without requiring fitting or adjusting and the use of fillers or shims.

With my improved apparatus a heated stock bar is fed intermittently into the apparatus until the forwardmost end thereof contacts a stop member. A movable gripper die engages the bar adjacent its forwardmost end and moves it into engagement with a stationary gripper die. A head forming die and means for forming a tapered end portion simultaneously engage the bar to form a tapered end portion and spike head, thus forming a composite finished spike.

DESCRIPTION OF THE DRAWINGS

Apparatus embodying features of my invention are illustrated in the accompanying drawings, forming a part of this application, in which:

FIG. 11 is a fragmental plan view showing the finished spike being ejected from the movable gripper die;

FIG. 12 is a vertical section view taken generally along the line 12—12 of FIG. 10;

FIG. 13 is a view taken generally along the line 13—13 of FIG. 12;

DETAILED DESCRIPTION

Figure 1:
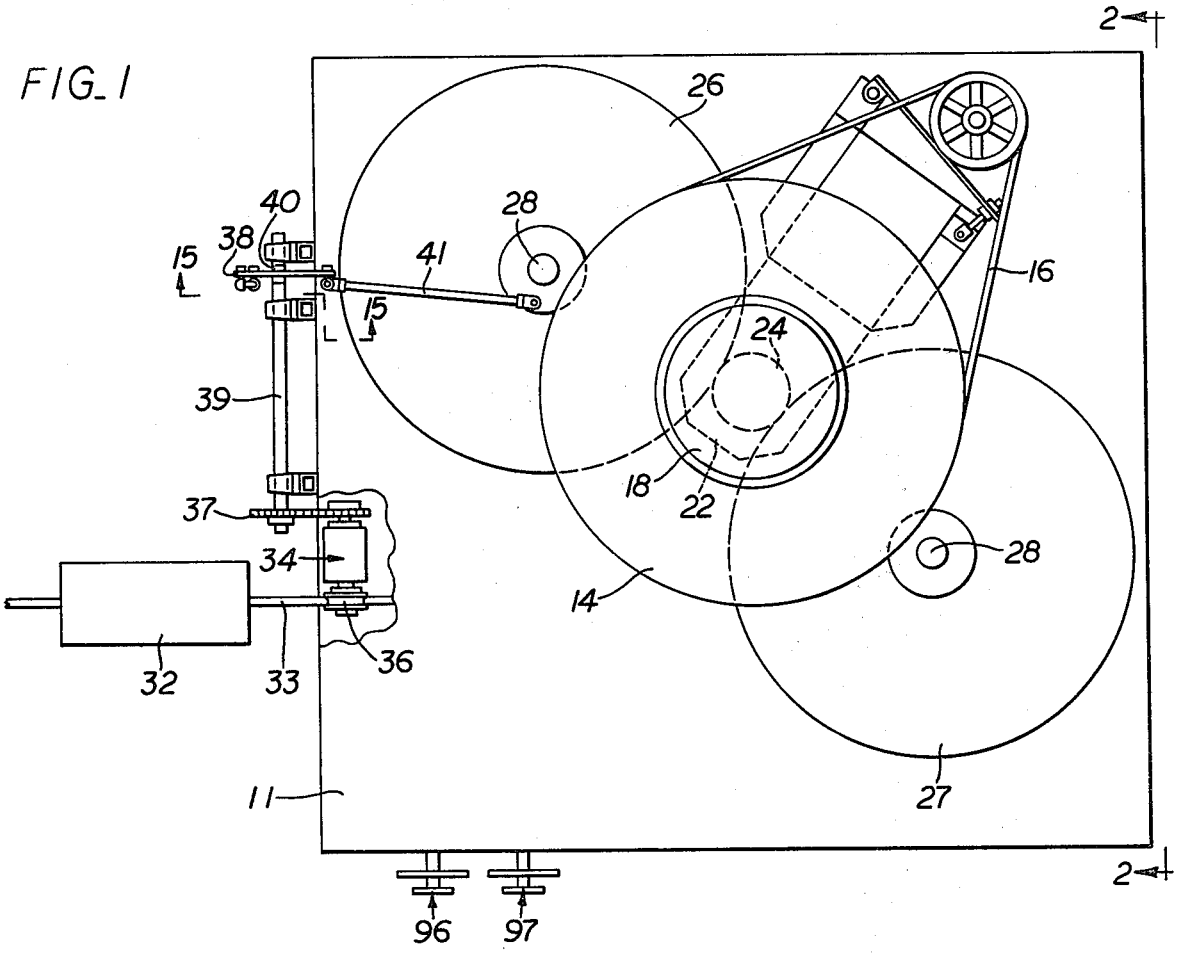
FIG. 1 is a top plan view looking down on the main drive unit.
Figure 2:
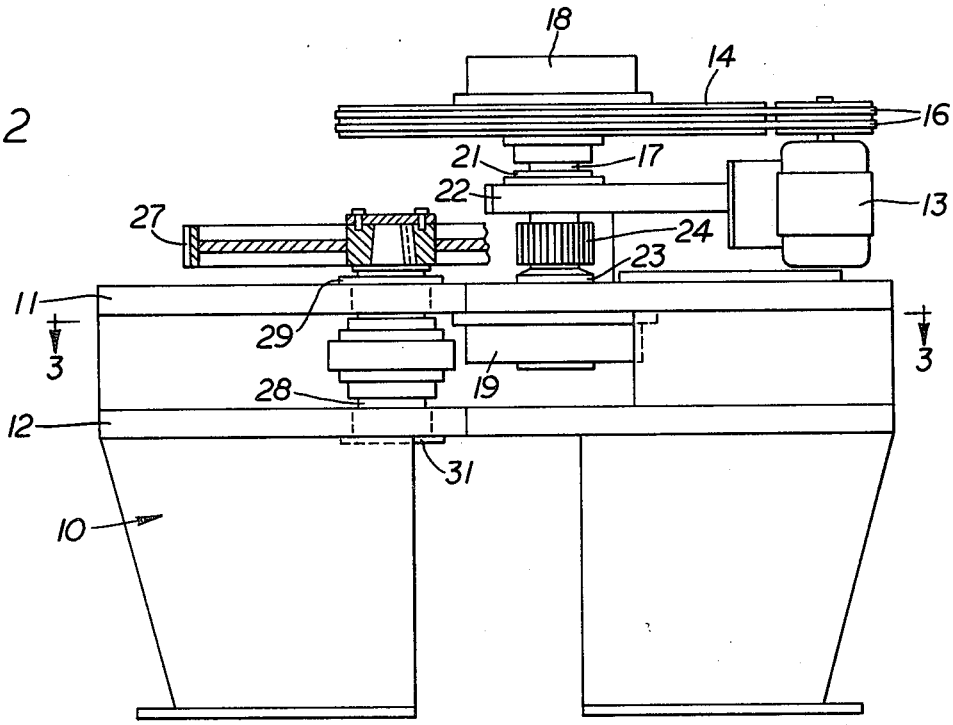
FIG. 2 is an elevational view taken generally along line 2—2 of FIG. 1.

Referring now to the drawings for a better understanding of my invention, I show in FIGS. 1 and 2 a supporting frame 10 having a top mounting plate 11 and bottom mounting plate 12. My apparatus is driven by conventional drive means such as an electric motor 13 which drives a flywheel 14 through a set of V-belts 16. The flywheel 14 is mounted on and drives a vertical main drive shaft 17 as shown. Mounted on the upper end of the drive shaft 17 is an air operated clutch 18 which provides for quick engagement and disengagement of the drive means from the driven part of the apparatus. A spring-operated air release brake 19 is mounted on the lower side of the top mounting plate 11 for quickly stopping the apparatus after clutch disengagement.

The main drive shaft 17 is supported by a suitable bearing unit 21 which is carried by a laterally extending frame overarm 22 and bearing 23 carried by the top mounting plate 11 as shown in FIG. 2. A pinion 24 is carried by the drive shaft 17 between the frame overarm 22 and the top mounting plate 11 in position to mesh with a driven unit, such as a gear 26 and a driven component, such as gear 27. As shown in FIG. 2, the driven gear 27 is carried by a vertical crankshaft 28 mounted in bearing units 29 and 31 located in the top and bottom mounting plates 11 and 12, respectively. Since the mounting assembly for the driven gear 26 is identical to that of the driven gear 27, no further description thereof is deemed necessary.

Figure 15:
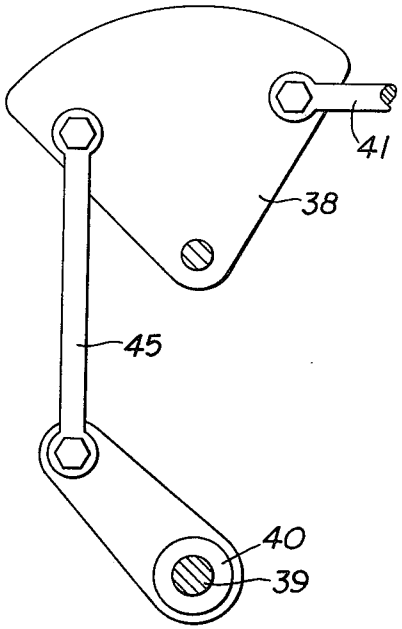
FIG. 15 is a vertical sectional view taken generally along the line 15—15 of FIG. 1.

A conventional induction furnace 32 heats an elongated stock bar 33 just prior to entry into my apparatus as shown in FIG. 1. The heated stock bar 33 is moved through the furnace 32 and then forwardly into my apparatus by conventional bar feed means secured to the bottom mounting plate 12 as shown generally at 34 in FIGS. 1, 3 and 4. The bar feed means 34 comprises two vertically spaced feed rolls 36 driven by a roller chain and sprocket assembly indicated generally at 37, FIG. 1, which is in turn operatively connected to a rocker arm 38 by a shaft 39, a conventional over-running clutch shown generally at 40 and a link 45 as shown in FIG. 15. A pitman arm 41 is operatively connected at one end to the driven gear 26 and at its other end to the rocker arm 38, as shown. With the feed rolls 36 thus being operatively connected to the driven gear 26, rotation of the gear 26 in turn transfers motion through the pitman arm 41, the rocker arm 38, the link 45 and the over-running clutch 40 thus driving the shaft 39 and the chain and sprocket assembly 37 to impart rotation to the feed rolls 36.

Figure 3:
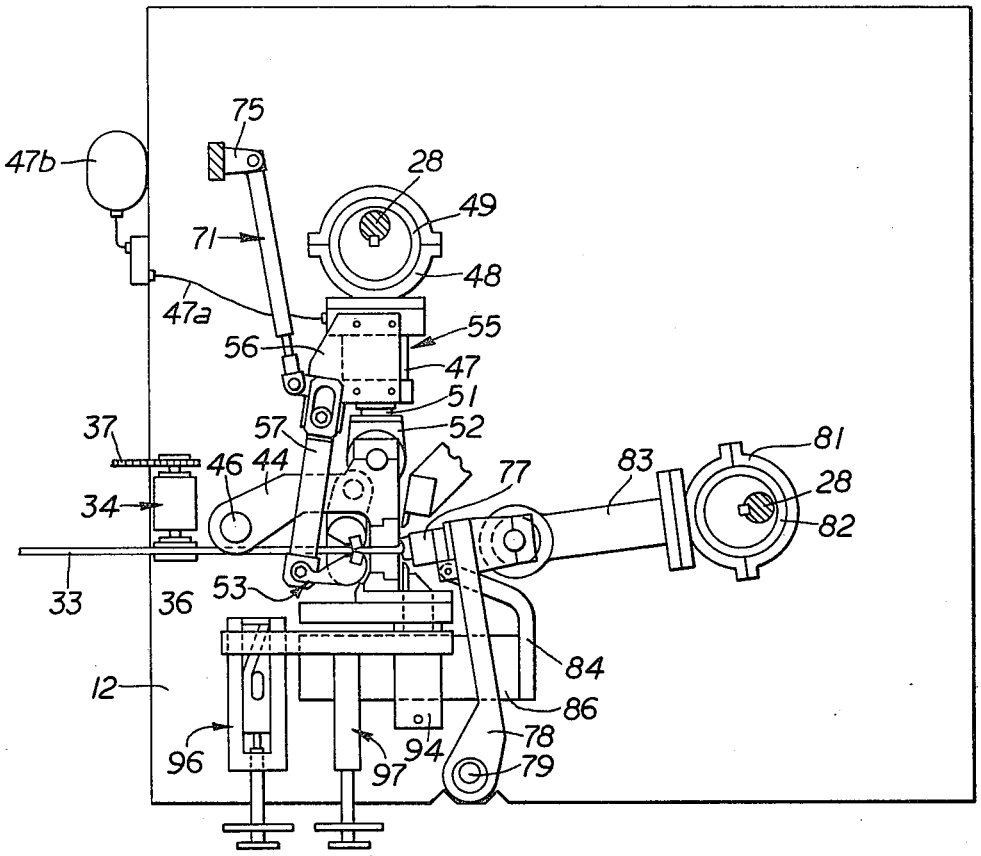
FIG. 3 is a horizontal sectional view taken generally along line 3—3 of FIG. 2 showing the apparatus in the closed spike forming position.
Figure 4:
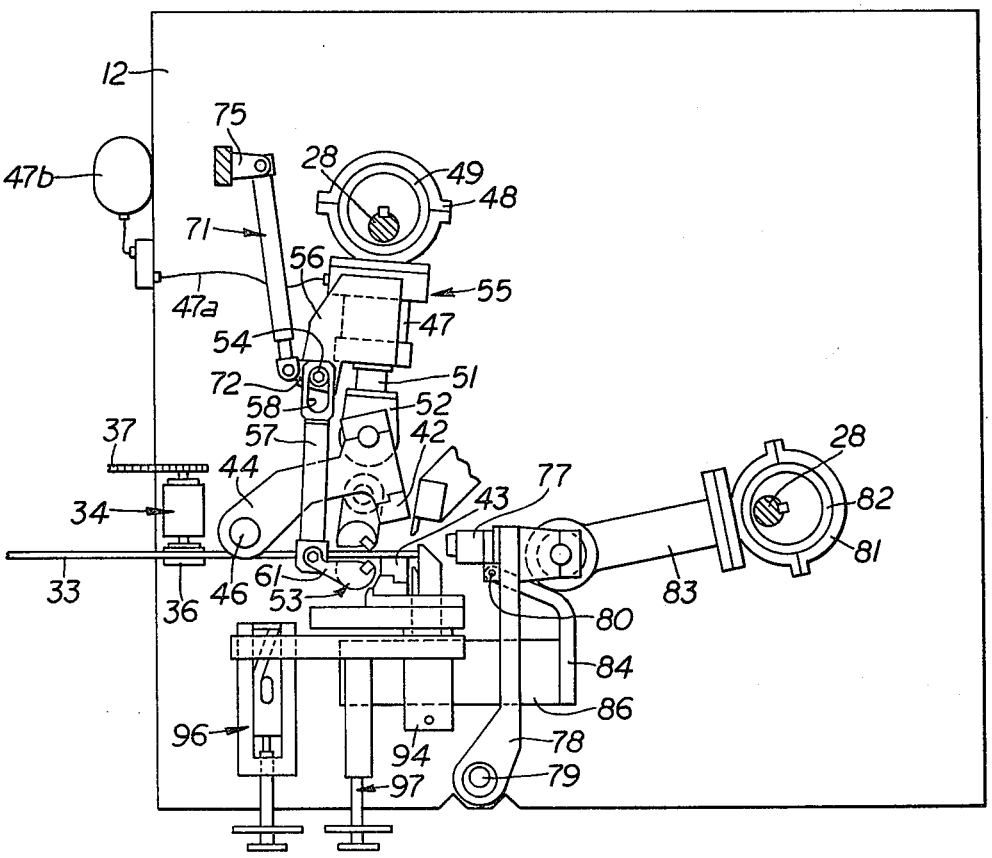
FIG. 4 is a horizontal sectional view corresponding to FIG. 3 showing the apparatus in the open position.
Figure 5:
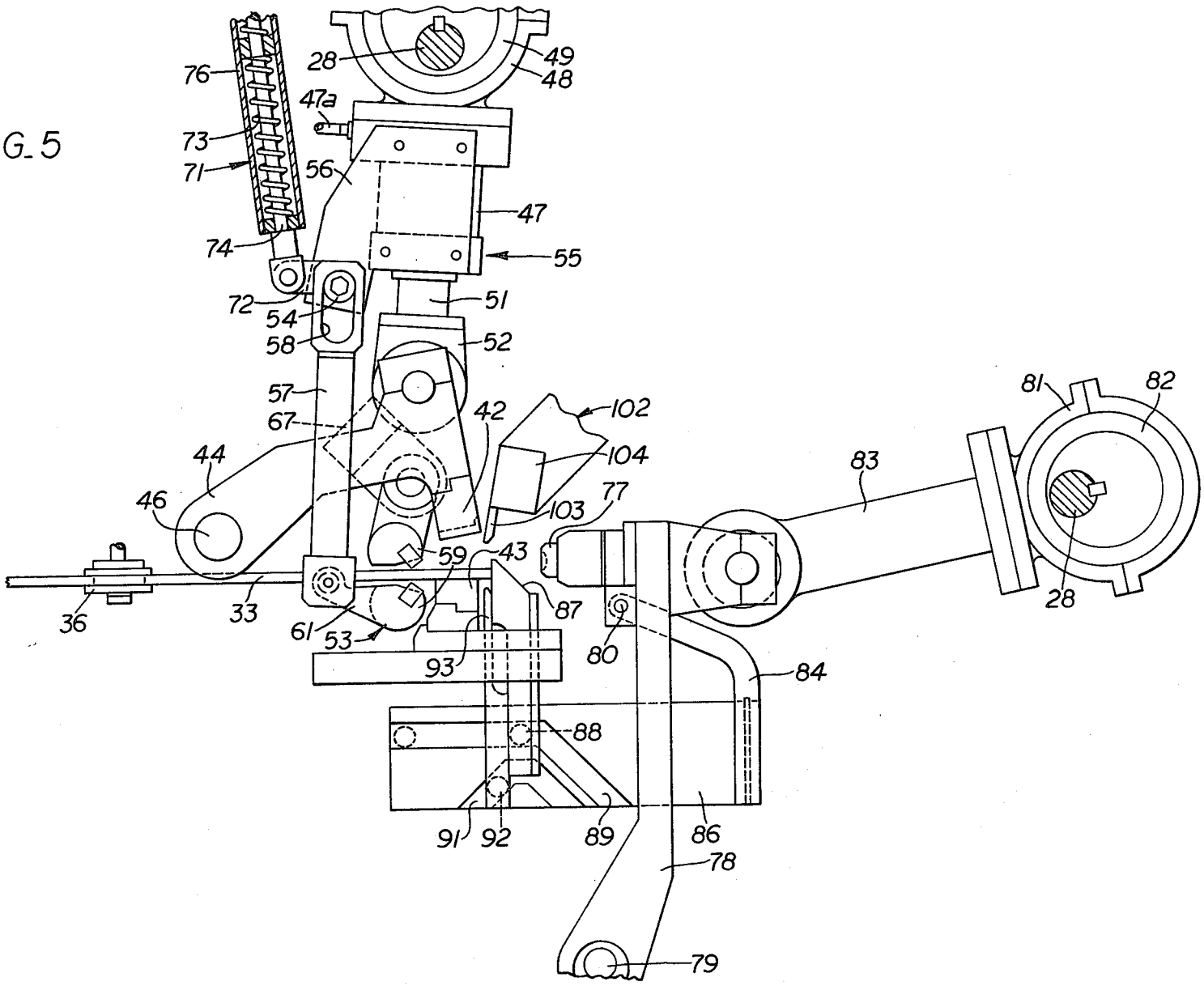
FIG. 5 is an enlarged plan view corresponding to FIG. 4 showing the forwardmost end of the stock bar contacting the stop member.
Figure 6:
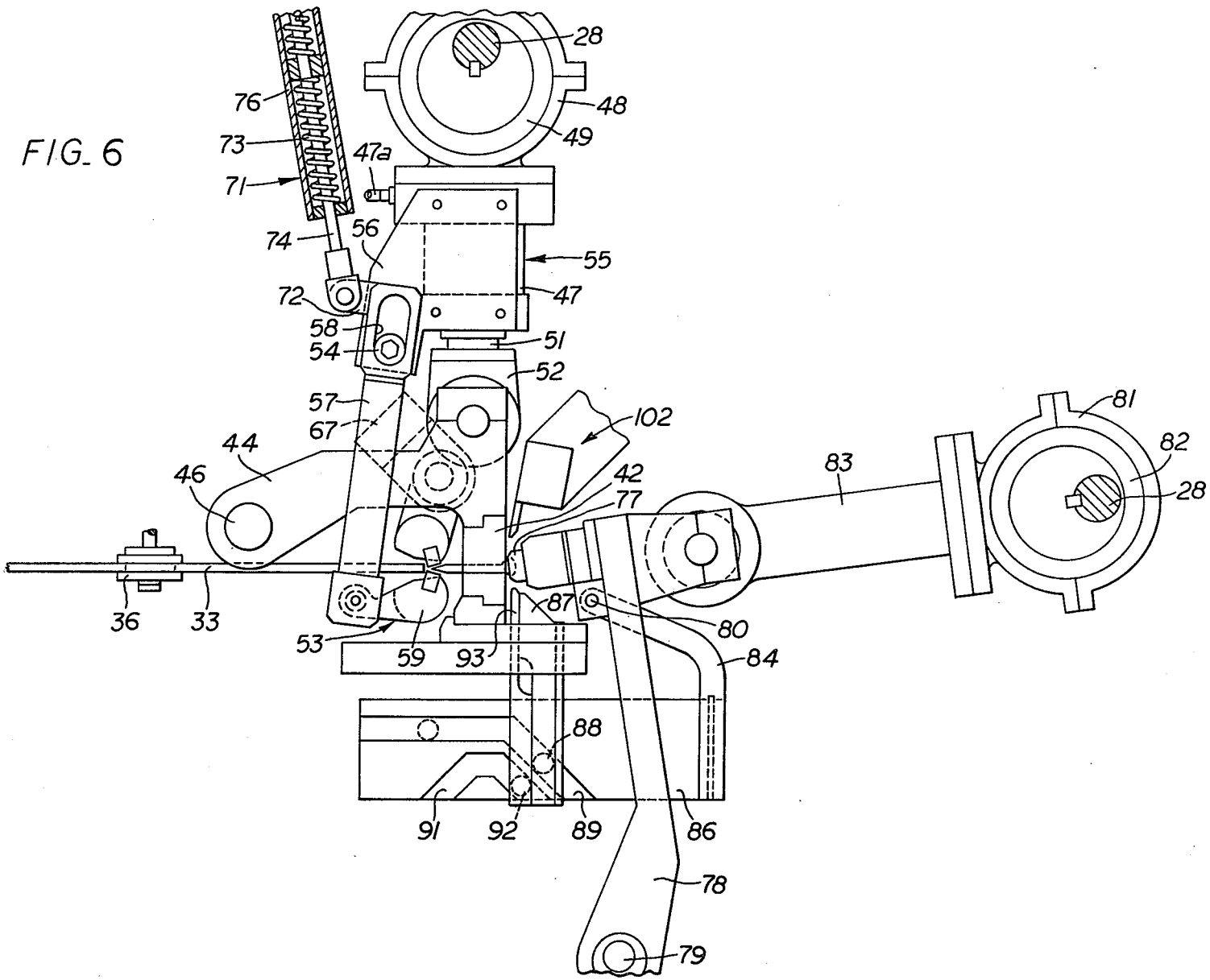
FIG. 6 is an enlarged plan view corresponding to FIG. 3 showing the finished spike separated from the stock bar.

A movable gripper die 42 is also driven by the driven gear 26 and is adapted for movement into gripping engagement with one side of the bar 33. The other side of the bar 33 is gripped by a stationary gripper die 43 as shown in FIGS. 3–11. The movable gripper die also carries a cavity 50 as shown in FIG. 8 to aid in forming the under side of a spike head. An elongated arm 44 is connected at one end to a pivot shaft 46 which extends between the top and bottom mounting plates 11 and 12 and is supported for pivotal movement by suitable bearings. The pivot shaft 46 is forward of the feed rolls 36 and rearward of the forwardmost end of the bar 33 for a purpose to be hereinafter described. The other end of the elongated arm 46 carries the movable gripper die 42 and is operatively connected to shock absorber means shown generally at 55. The shock absorber means may be in the form of a fluid pressure operated cylinder, such as an air cylinder 47, which is eccentrically mounted at one end to the crank shaft 28 of the driven gear 26 by a split housing 48 carrying roller bearings 49, as shown in FIGS. 5 and 6. The cylinder 47 is provided with a piston rod 51 having a rod eye 52 which in turn is operatively connected to the other end of the elongated arm 44 adjacent the movable gripper die 42 as shown. The end of the cylinder 47 eccentrically mounted to the crankshaft 28 is connected by a line 47*a* to an accumulator 47*b*, as as shown in FIGS. 3 and 4, which supplies a gas at a predetermined low pressure to the cylinder 47 whereby the rod 51 is maintained at a fully extended position while the movable gripper die 42 is in open position. Accordingly, upon moving the movable gripper die 42 toward closed position, the piston rod 51 telescopes into the cylinder 47 a partial amount of its total stroke so that the remaining portion of its stroke serves as a buffer or cushion to prevent damage to the apparatus in the event there is a restraint or blockage of the movement of the movable die toward the closed position and at the same time the crankshaft 28 is allowed to go through the closing portion of the cycle.

Figure 7:
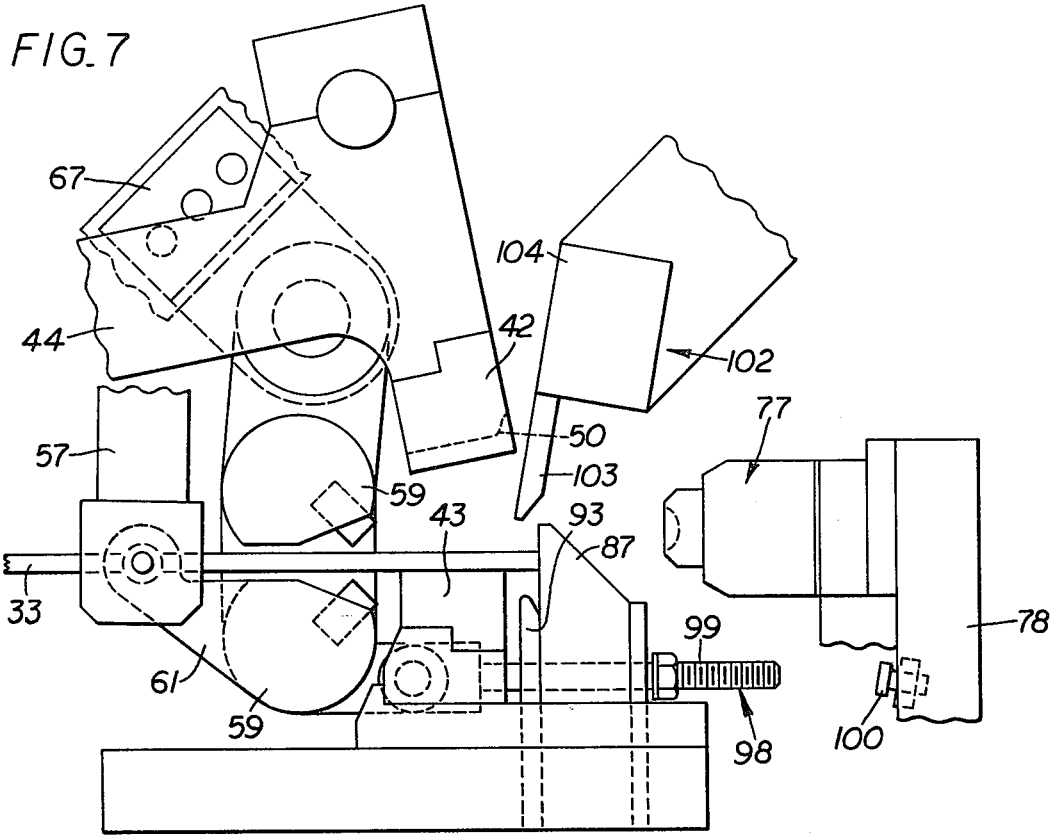
FIG. 7 is an enlarged fragmental plan view showing a portion of the apparatus shown in FIGS. 4 and 5.
Figure 8:
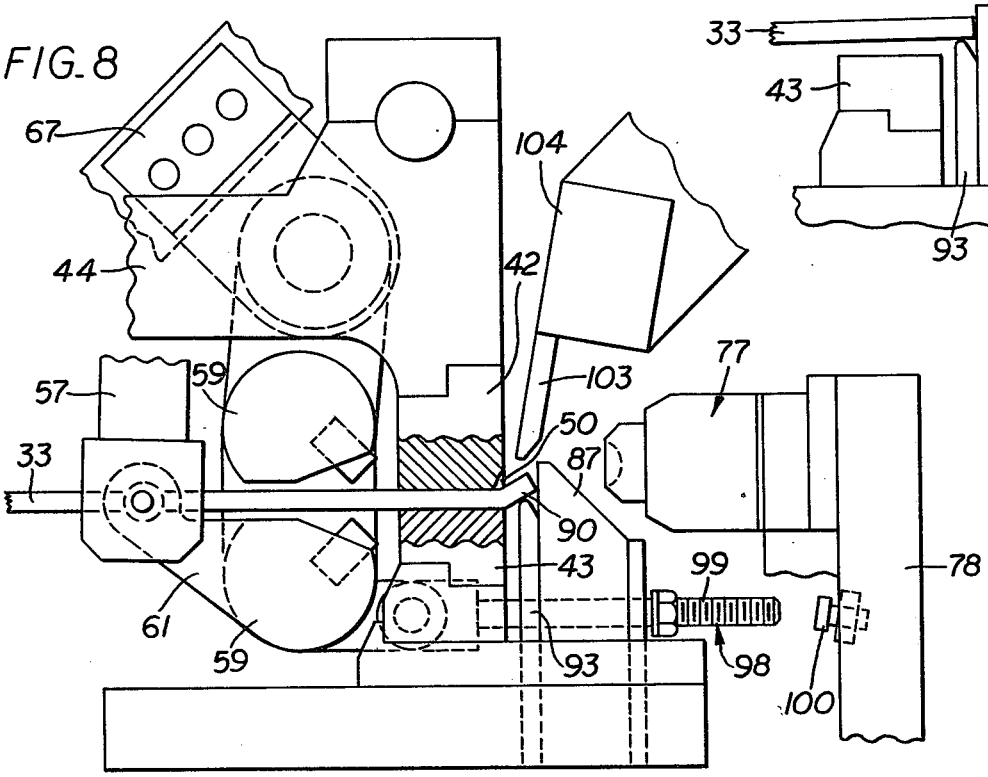
FIG. 8 is a fragmental plan view showing the forwardmost end portion after it is bent laterally.
Figure 9:
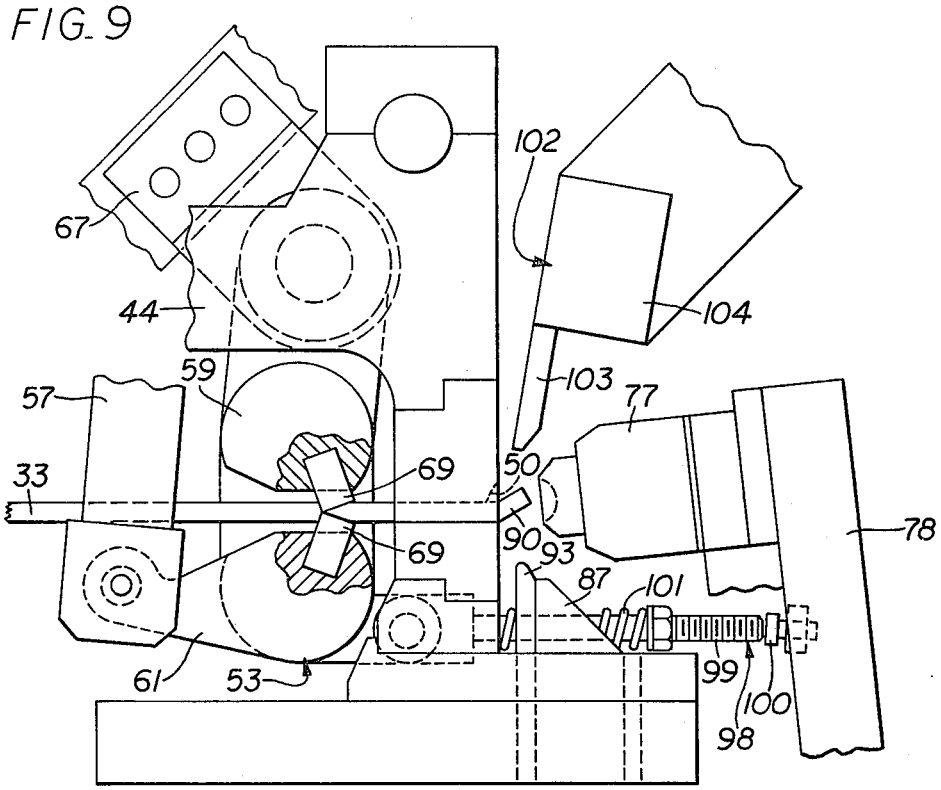
FIG. 9 is a fragmental plan view showing the formation of the tapered end portion by the cutter dies.

As the driven gear 26 rotates the movable gripper die 42 is moved selectively to an open position with the movable gripper die 42 spaced from one side of the bar 33 adjacent the forwardmost end thereof, as shown in FIGS. 4, 5 and 7, and to a closed position in engagement with the bar 33 thus forcing the opposite side of the bar into engagement with the stationary gripper die 43 as shown in FIG. 9. It will be understood that the shock absorber means may assume other forms such as a spring which imparts movement to the movable gripper die 42 and also forms the buffer mentioned above.

Also, driven concomitantly with the bar feed means and the movable gripper die 42 is mechanism 53 for forming a tapered end portion for each spike formed from the bar 33. The mechanism 53 comprises a cam follower 54 carried by a bracket 56 which in turn is mounted on the cylinder 47 as shown in FIGS. 3, 4, 5 and 6. An elongated connector arm 57 is provided with an elongated cam slot 58 adjacent one end thereof in position to receive the cam follower 54 with the other end thereof being operatively connected to one of two oppositely disposed cutter die housings 59, as shown in FIGS. 7–10, through a crank arm 61. As shown in FIGS. 12 and 13 the crank arm 61 is detachably connected to one of the housings 59. The oppositely disposed housings 59 are operatively connected and are oscillated by two vertically mounted shafts 62 with each carrying an intermeshing gear 63 at its lower end. The shafts 62 are supported for rotation within a housing 64 by suitable bearings 66. The housing 64 is pivotally connected to a bracket 67 which is operatively connected to the bottom mounting plate 12 as shown in FIGS. 7, 8, 9 and 10.

Figure 10:
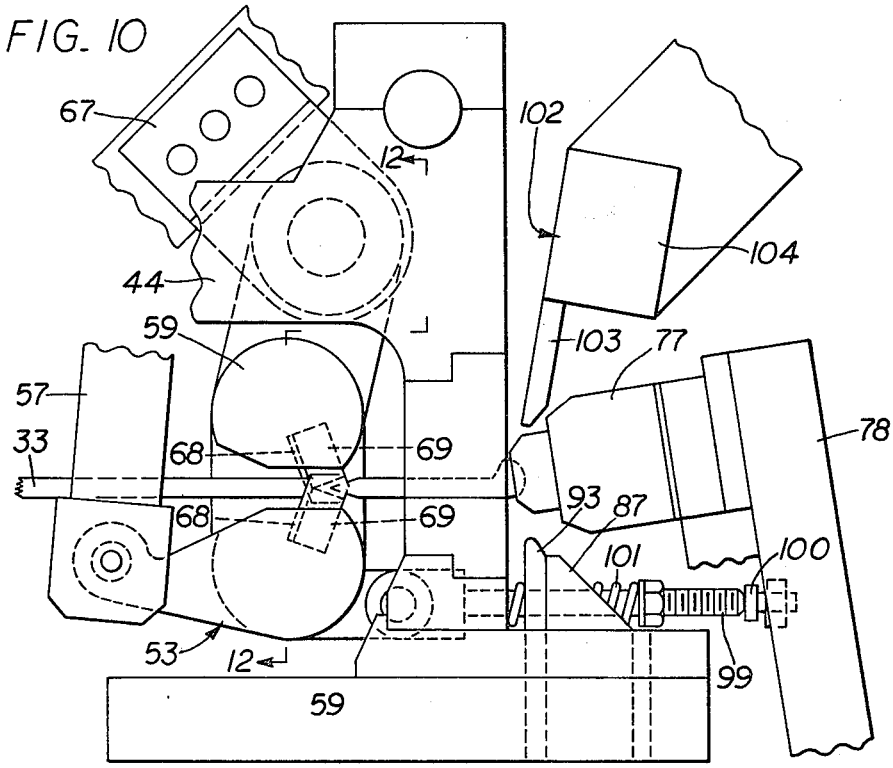
FIG. 10 is a fragmental plan view showing the head being formed concomitantly with separation of the tapered end portion from the bar.

Each cutter die housing 59 carries a plate-like member 68 and a cutter die 69 with each being adapted to move selectively to an open position, as shown in FIG. 9, with the bar 33 passing between the cutter dies 69 and to a closed position, as shown in FIG. 10, with the cutter dies 69 oscillating into engagement with the bar 33 to shear the bar into and concomitantly form a tapered end portion. The plate-like members 68 are oppositely disposed and mounted in vertical spaced relation to each other in position to extend alongside its adjacent cutter die 69 as shown in FIG. 12. The plate-like members 68 cover, overlap and confine adjacent flat parallel sides of the tapered end portion which are perpendicular to the tapered surfaces of the tapered end portion to substantially reduce deformation when the cutter dies 69 move to the closed position.

A retractor unit 71 for maintaining the cutter dies 69 in the open position is shown generally at 71 in FIGS. 3, 4, 5 and 6. The retractor unit is operatively connected to and extends between a laterally extending arm 72 provided on the connector arm 57 adjacent the cam slot 58 and a suitable bracket 75 carried by the lower side of the top mounting plate 11. The retractor unit 71 may be in the form of a spring 73 telescoped over an elongated rod-like member 74 enclosed within a tube-like housing 76. The spring 73 is compressed and its tension overridden during each revolution of the driven gear 26 in response to movement of the cutter dies 69 to the closed position as shown in FIG. 6. Upon returning to its extended position, as shown in FIG. 5, the spring 73 aids in moving the cutter dies 69 to open position and then holding them in open position. The cam slot 58 is of a length to accommodate excess motion of the cam follower 54 as it moves the cutter dies toward open position. Excess motion occurs since movement of the crank arm 61 which moves the cutter dies travels approximately one-half the distance of travel of the crank shaft 28. From the foregoing it will be seen that the driven gear 26 drives concomitantly the bar feed means 34, the movable gripper die 42 and the mechanism 53 for forming the tapered end portion of the spike.

A head forming die 77 is carried by an elongated arm 78 which is operatively connected to and driven by the driven gear 27. The arm 78 is eccentrically mounted on a pivot shaft 79 extending between and secured to the top and bottom mounting plates 11 and 12, respectively. The eccentric end of the arm 78 is adjustable to provide control and distribution of the metal in the spike head. As shown in FIGS. 3–6, a split housing 81 carrying roller bearings 82 eccentrically connects a pitman arm 83 to the arm 78 adjacent the head forming die 77. FIG. 5 shows the head forming die 77 in a first position spaced forward of the forwardmost end of the bar 33. FIG. 6 shows the head forming die in a second position in engagement with the forwardmost end of the bar 33.

Figure 7A:
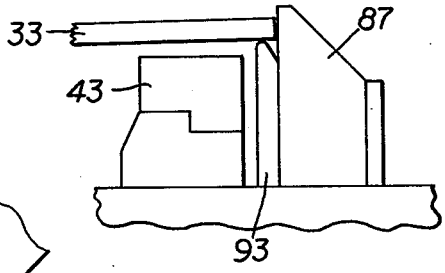
FIG. 7*a* is a fragmental view showing the bar positioned for lateral bending by the movable gripper die.

A laterally bent connector member 84 is pivotally connected at one end to the arm 78 adjacent the head forming die 77, as at 80, and is connected at its other end to a cam slide plate 86 as shown in FIGS. 5 and 6. A stop member 87 carries a cam follower 88 which rides in a cam slot 89 provided in the cam plate 86. The stop member 87 is mounted for reciprocatory movement to and from a position whereby it contacts the forwardmost end of the bar 33. A cam slot 91 is also provided in the cam plate 86 in position to receive a cam follower 92 carried by bending finger 93. The bending finger extends alongside the stop member 87 and is mounted for reciprocatory movement to a position to engage the bar 33 adjacent the forwardmost end as shown in FIG. 7*a*. The bending finger holds the forwardmost end of the bar 33 in spaced relation from the stationary gripper die 43 so that upon movement of the movable die 42 to the closed position, a laterally bent end portion 90 is formed as shown in FIG. 8.

An elongated bracket 94 pivotally connected to the top mounting plate 11 carries both the stop member 87 and the bending finger 93 as shown in FIG. 4. The bracket 94 may be rotated in a clockwise direction by a conventional adjusting mechanism shown generally at 96 to in turn move the stop member 87 so that the overall length of the finishing spike is increased. Likewise, a counterclockwise movement of the bracket 94 will result in a reduced length of the finished spike. Since such adjusting mechanism is well known in the art no further description is deemed necessary.

A conventional adjusting mechanism shown generally at 97 is secured to the cam slide plate 86 for adjusting the distance the forwardmost end of the bar 33 is held from the stationary die 43 by the bending finger 93. This adjustment regulates the length and the angle of the bend of the laterally bent end portion 90 of the bar 33.

An actuator member shown generally at 98 in FIGS. 9, 10 and 11 is interposed between the elongated arm 78 carrying the head forming die 77 and the cutter die housings 59. The actuator member 98 comprises an elongated threaded member 99 connected at one end to the cutter die housings 59 with the other end thereof in position to contact an adjustable element 100 carried by the elongated arm 78 when the head forming die 77 moves to the second position. A compression spring 101 is carried by the threaded member 99 in position to be compressed when the head forming die 77 moves to the second position, thus moving the pivotally mounted housing 59 carrying the cutter dies 69 rearwardly to separate the newly formed tapered end portion from the bar 33 as shown in FIG. 10. After separation of the bar 33 from the tapered end portion, the spring 101 is returned to its extended position with the cutter die housing 59 being returned to a predetermined location to form the tapered end portion of the next spike to be formed.

An ejector member shown generally at 102 in FIG. 11 is detachably connected to the bottom mounting plate 12 in position to contact the newly formed spike head and remove the finished spike from the grip of the movable gripper die 42 upon movement thereof to its open position. The ejector member 102 includes an elongated bar-like member 103 carried by a mounting bracket 104 detachably connected to the bottom mounting plate 12. The bar-like member 103 projects outwardly into the path of travel of the spike head, as shown.

From the foregoing description, the operation of my improved apparatus for forming spikes will be readily understood. With the cutter dies 69 and the movable gripper die 42 in the open position and the head forming die 77 in its first position, the stop member 87 extends laterally to a position to contact and limit forward movement of the forwardmost end of the heated bar 33 as shown in FIG. 7. Immediately, the bending finger 93 engages the bar 33 adjacent the forwardmost end and moves it to a position spaced from the stationary gripper die 43, as shown in FIG. 7*a*. With the bar 33 held in this spaced apart position, the movable gripper die 42 moves to its closed position into engagement with one side of the bar 33 and forces the opposite side of the bar into engagement with the stationary die whereby the forwardmost end is bent to form a laterally bent end portion 90, as shown in FIG. 8.

The stop member 87 and the bending finger 93 immediately retract after the laterally bent end portion 90 is formed. The cutter dies 69 then oscillate to the closed position to form the tapered end portion and concomitantly sever it from the remaining portion of the heated bar 33 as shown in FIG. 9. Prior to completion of the tapered end portion, the head forming die 77 begins moving rearwardly toward its second position. Immediately after completion of the tapered end portion, the head forming die 77 engages concomitantly the laterally bent end portion 90 to form the spike head and the actuator member 98 to separate the newly formed tapered end portion from the remaining portion of the bar 33, thus forming a composite finished spike as shown in FIG. 10. The ejector member 102 then contacts the spike head and ejects the finished spike from the grip of the movable die 42 as the movable die 42 moves away from its closed position as shown in FIG. 11.

Figure 14:
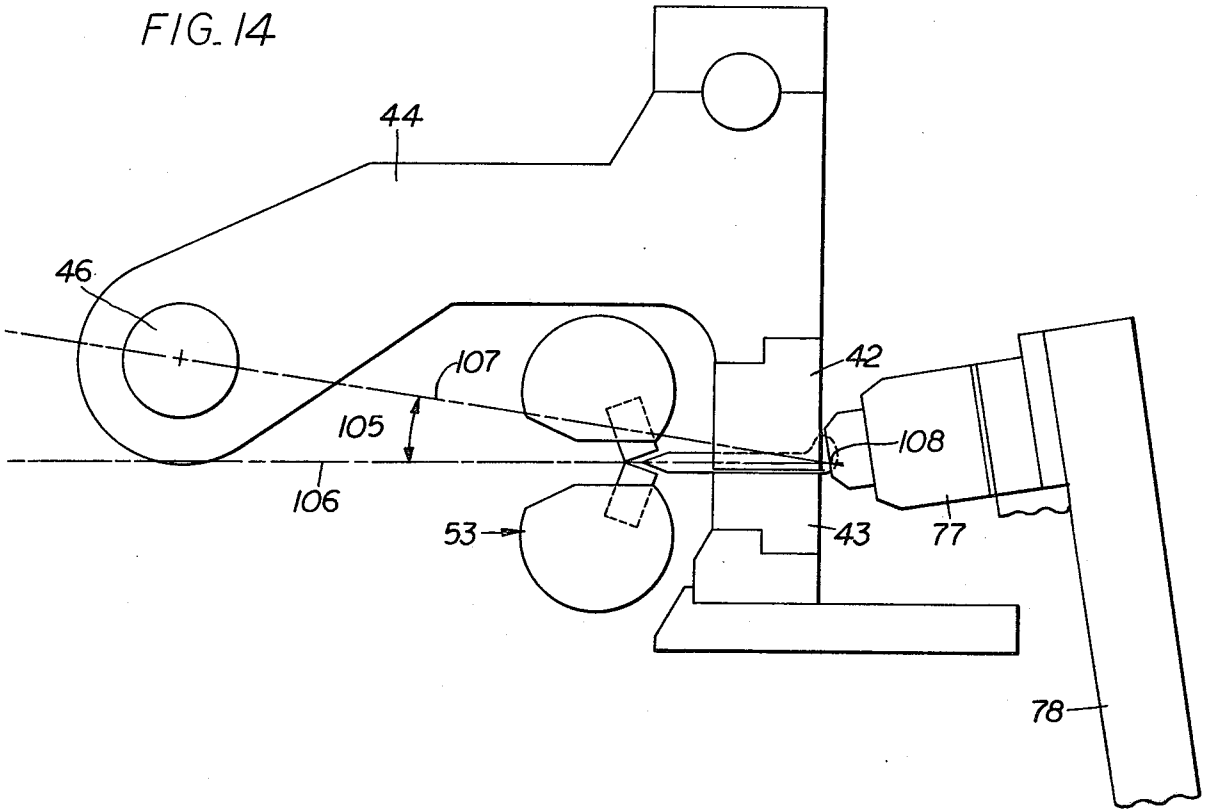
FIG. 14 is a diagrammatic view showing the relationship of the pivot arm to the longitudinal center of the bar.

The pivot shaft 46 is connected to the top and bottom mounting plates of the support frame 10 rearward of the forwardmost end of the bar 33 to define an included angle 105 between the intersection of a first line 106 extending along the longitudinal center of the bar 33 and a second line 107 extending from the pivot shaft 46 of the elongated arm 44 to the point of intersection 108 of the first line 106 with the head forming die 77 as shown in FIG. 14. It is critical that the included angle 104 be an acute angle. Preferably the acute angle ranges from 7° to 11°. By providing such an acute angle, a self-adjusting gripping force is created between the movable die 42 and the stationary die 43 when the movable die is in the closed position due to the interacting relationship of the elongated arm 44 pivotally mounted at the included angle 104 from the bar 33 and the rearward and downward force exerted by the head forming die 77 on the laterally bent end portion of the bar 33. In other words, as the head forming die 77 engages the laterally bent end portion 90 to urge it into the cavity 50 of the movable die 42, the downward and rearward force exerted by the head forming die is transfered through the laterally bent end portion 90 to the cavity 50 thus moving the movable die 42 toward gripping engagement with the bar 33. The amount of gripping force thus exerted by the movable gripper die 42 is proportional to the force exerted by the head forming die whereby a composite finished spike is formed in a single stage operation. Accordingly, my apparatus is particularly adapted for use with stock bars which vary in hardness and temperature with the soft or hotter bars requiring less force to urge the laterally bent end portion 90 into the cavity 50 and consequently less gripping force as compared to a colder or hard stock bar.

From the foregoing, it will be seen that I have devised an improved apparatus for producing railroad spikes and the like at a high rate of production in a safe, economical and consistant manner. Also, my apparatus produces spikes in a single stage operation that have true tapered end portions and wherein a self-adjusting gripping force is applied in proportion to the amount of force required to form the head. Furthermore, my apparatus is simple of construction, requires a minimum of cooperating components and functions to form the finished spikes and is trouble-free in operation thus requiring a minimum of maintenance and down time.

While I have shown my invention in but one form, it will be obvious to those skilled in the art that it is not so limited, but is susceptible of various changes and modifications without departing from the spirit thereof.

What I claim is:

1. In apparatus for forming railroad spikes and the like from a heated stock bar and having drive means, bar feed means, a head forming die, and movable and stationary gripper dies, the improvement comprises:

(a) a supporting frame, (b) a stop member mounted for reciprocatory movement to a position to contact the forwardmost end of said bar and limit forward movement thereof, (c) means supporting said movable gripper die for movement selectively to an open position relative to one side of said bar adjacent said forwardmost end and to a closed position in engagement with said one side so that the opposite side of said bar adjacent said forwardmost end is forced into engagement with said stationary gripper die, (d) a bending finger mounted for reciprocatory movement alongside said stop member to a position to engage said opposite side of said bar adjacent said forwardmost end and move said forwardmost end to a position spaced from said stationary gripper die while said movable gripper die is in said open position, to provide a laterally bent end portion at said forwardmost end upon movement of said movable gripper die to said closed position, (e) means for forming a tapered end portion on said bar at a predetermined location spaced longitudinally from said forwardmost end, (f) actuator means for moving said head forming die selectively to a first position spaced forwardly of said bar and to a second position with said head forming die engaging said laterally bent end portion at said forwardmost end and forcing said laterally bent end portion toward engagement with said movable gripper die to in turn move said movable gripper die toward gripping engagement with said bar so that the gripping force exerted by said movable gripper die is proportional to the force exerted by said head forming die whereby a composite finished spike is formed in a single stage operation, and (g) means for ejecting said finished spike in response to movement of said movable gripper die away from said closed position.

2. Apparatus as defined in claim 1 in which said means for supporting said movable gripper die comprises:

(a) a drive unit of said drive means operatively connected to said movable gripper die, (b) an elongated arm carrying said movable gripper die adjacent one end thereof and pivotally connected adjacent the other end thereof to said supporting frame rearwardly of said forwardmost end of said bar at a location to define an included acute angle between the intersection of a first line extending along the longitudinal center of said bar and a second line extending from the pivot point of said arm to the point of intersection of said first line with said head forming die while said head forming die is in said second position, and (c) resilient shock absorber means operatively connected at one end to said drive unit and pivotally connected at its other end to said elongated arm defining a buffer between said drive unit and said movable gripper die with said shock absorber means being actuatable in response to a predetermined pressure being applied thereto by said movable gripper die.

3. Apparatus as defined in claim 2 in which said acute angle ranges from substantially 7° to 11°.

4. Apparatus as defined in claim 2 in which said shock absorber means is a fluid pressure operated cylinder.

5. Apparatus as defined in claim 2 in which said drive unit is eccentrically mounted for reciprocatory movement on said supporting frame.

6. Apparatus as defined in claim 1 in which said actuator means comprises:

(a) a drive component of said drive means operatively connected to said head forming die, (b) an elongated member pivotally connected at one end to said supporting frame and carrying said head forming die on the other end thereof, and (c) a pitman arm operatively connected at one end to said elongated member adjacent said head forming die and operatively connected at the other end thereof to said drive component for moving said head forming die in a direction to exert a force in a rearward and downward direction on said laterally bent end portion while said head forming die is in said second position.

7. Apparatus as defined in claim 6 in which said elongated member carrying said head forming die is eccentrically mounted on said supporting frame.

8. Apparatus as defined in claim 6 in which said drive component is eccentrically mounted for reciprocatory movement on said supporting frame.

9. Apparatus as defined in claim 1 in which said means for forming said tapered end portion comprises:

(a) cutter dies mounted for oscillatory movement at opposite sides of said bar in position to engage and shear opposite sides of said bar to thus form said tapered end portion and concomitantly sever said tapered end portion from said bar, (b) means for oscillating said cutter dies from a spaced apart open position allowing said bar to travel therebetween to a closed position in engagement with said bar, and (c) means interposed between and operatively connecting said elongated member carrying said head forming die to said cutter dies for moving said cutter dies rearwardly of said predetermined location and move said bar away from said tapered end portion.

10. Apparatus as defined in claim 9 in which a housing is mounted on said supporting frame adjacent said predetermined location and rearwardly of said movable and stationary gripper dies and carries said cutter dies and confining means is carried by said housing restraining deformation of the sides of said tapered end portion which are perpendicular to the tapered surfaces defining said tapered end portion while said cutter dies are in said closed position.

11. Apparatus as defined in claim 10 in which said housing is pivotally mounted on said supporting frame.

12. Apparatus as defined in claim 10 in which said confining means comprises a pair of oppositely disposed spaced apart plate-like elements with each plate-like element extending alongside an adjacent cutter die in position to move inwardly alongside said bar and cover the adjacent side of said tapered end portion while said cutter die is in said closed position.

13. Apparatus as defined in claim 9 in which said means for oscillating said cutter dies comprises:

(a) a cam follower carried by said fluid pressure operated cylinder, (b) a crank arm connected at one end to said housing carrying said cutter members and pivotally connected at the other end thereof to one end of an elongated connector arm, (c) said elongated connector arm having a cam slot adjacent the other end thereof in position to receive said cam follower, and (d) resilient means urging said elongated connector arm toward said open position.

14. Apparatus as defined in claim 13 in which said resilient means is a spring actuated unit.

15. Apparatus as defined in claim 9 in which said means for separating said tapering end portion from said bar comprises:

(a) an elongated rod operatively connected at one end to said housing carrying said cutter dies with the other end thereof in position to contact said elongated member carrying said head forming die when said cutter dies are in said closed position to thus move said housing rearwardly from said predetermined location, (b) resilient means for returning said cutter dies to said predetermined location, and (c) means carried by said elongated member for varying the amount of movement of said housing rearwardly from said predetermined location.

16. Apparatus as defined in claim 15 in which said means varying the amount of movement of said housing is an elongated threaded member in threaded engagement with said elongated member with said threaded member being in position to contact said other end of said elongated rod upon movement of said head forming die to said second position.

17. Apparatus as defined in claim 15 in which said resilient means is a spring actuated unit carried by said elongated rod.

18. Apparatus as defined in claim 1 in which said means for ejecting said finished spike comprises:

(a) a mounting bracket connected to said supporting frame, (b) a bar-like member carried by said mounting bracket with one end thereof projecting downwardly and rearwardly toward the forwardmost end of said stationary gripper die in position to contact the head of the finished spike upon movement of said movable die away from said closed position.

* * * * *